US009630234B2

(12) United States Patent
Blue et al.

(10) Patent No.: US 9,630,234 B2
(45) **Date of Patent: *Apr. 25, 2017**

(54) GAS COOLING METHOD FOR CAN FORMING

(71) Applicant: Stolle Machinery Company, LLC, Centennial, CO (US)

(72) Inventors: Rodney Adolph Blue, Huntington Beach, CA (US); Karl S. Fleischer, Denver, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/086,198

(22) Filed: Mar. 31, 2016

(65) Prior Publication Data

US 2016/0207089 A1 Jul. 21, 2016

Related U.S. Application Data

(63) Continuation of application No. 13/875,649, filed on May 2, 2013, now Pat. No. 9,327,333.

(60) Provisional application No. 61/643,473, filed on May 7, 2012.

(51) Int. Cl.

| | |
|---|---|
| ***B21D 22/28*** | (2006.01) |
| ***B21D 37/16*** | (2006.01) |
| ***B21D 51/26*** | (2006.01) |

(52) U.S. Cl.

CPC ..... *B21D 37/16* (2013.01); *B21D 22/28* (2013.01); *B21D 22/286* (2013.01); *B21D 51/26* (2013.01)

(58) Field of Classification Search

CPC ..... B21D 22/28; B21D 22/286; B21D 24/16; B21D 37/16; B21D 37/18

See application file for complete search history.

(56) References Cited

U.S. PATENT DOCUMENTS

| | | | |
|---|---|---|---|
| 3,274,813 | A | 9/1966 | Aleck |
| 4,134,319 | A | 1/1979 | Clark |
| 4,502,313 | A | 3/1985 | Phalin et al. |
| 5,460,024 | A | 10/1995 | Meneghin et al. |
| 5,555,761 | A | 9/1996 | Lavy |
| 5,632,171 | A | 5/1997 | Kunka et al. |
| 6,367,304 | B1 | 4/2002 | Fahrenbach |
| 2003/0084700 | A1 | 5/2003 | Blue |

(Continued)

FOREIGN PATENT DOCUMENTS

| | | |
|---|---|---|
| GB | 2005580 | 4/1979 |
| GB | 2181082 | 4/1987 |

(Continued)

*Primary Examiner* — Debra Sullivan

(74) *Attorney, Agent, or Firm* — Eckert Seamans Cherin & Mellott, LLC; David C. Jenkins

(57) ABSTRACT

A cooling gas system for a can bodymaker tool pack is provided. The cooling gas system uses a compressed gas to cool a punch and/or a die pack. That is, a compressed gas is delivered to at least one location adjacent the punch and die pack. A nozzle assembly directs the compressed gas toward a selected location. As the compressed gas passes through the nozzle assembly, or immediately after passing through the nozzle assembly, the compressed gas expands. As is known, an expanding gas cools as it expands. Thus, a cool gas is directed to the surface of the punch and the die pack. The cool gas absorbs heat from the punch and die pack thereby cooling the heated components.

19 Claims, 2 Drawing Sheets

(56) References Cited

U.S. PATENT DOCUMENTS

| | | | |
|---|---|---|---|
| 2009/0126900 | A1 | 5/2009 | Scherer et al. |
| 2011/0162724 | A1 | 7/2011 | Kleckler |
| 2011/0239726 | A1 | 10/2011 | Crabtree |

FOREIGN PATENT DOCUMENTS

| | | |
|---|---|---|
| GB | 2292707 | 6/1996 |
| JP | 02417757 | 8/1992 |
| JP | HEI.09-210526 | 8/1997 |
| JP | 2006-102757 | 4/2006 |
| JP | 2007-245209 | 9/2007 |
| JP | 2008-36709 | 2/2008 |
| WO | WO93/22079 | 11/1993 |

GAS COOLING METHOD FOR CAN FORMING

CROSS REFERENCE TO RELATED APPLICATION

This application is a continuation patent application of U.S. patent application Ser. No. 13/875,649, filed May 2, 2013, which application claims priority to U.S. Provisional Patent Application Ser. No. 61/643,473, filed May 7, 2012, entitled, GAS COOLING METHOD FOR CAN FORMING.

BACKGROUND OF THE INVENTION

Field of the Invention

The disclosed and claimed concept relates to a can bodymaker tool pack structured to form a cup-shaped body and, more specifically, to a cooling gas system for the can bodymaker tool pack.

Background Information

It is known in the container-forming art to form two-piece containers, e.g., cans, in which the walls and bottom of the container are a one-piece cup-shaped body, and the top or end closure is a separate piece. After the container is filled, the two pieces are joined and sealed, thereby completing the container.

Cups are formed in a can bodymaker having a tool pack structured to form the cup-shaped body from sheet material. That is, the cup-shaped body typically begins as a flat material, typically metal, either in sheet or coil form. Blanks, i.e., disks, are cut from the sheet stock and then drawn into a cup. That is, by moving the disk through a series of dies while disposed over a ram or punch, the disk is shaped into a cup having a bottom and a depending sidewall. The cup may be initially formed in one bodymaker and transferred to another to be drawn into an elongated can, or, the cup may be formed and drawn into a can within a single bodymaker.

In forming the can, the cup may be drawn through additional dies to reach a selected length and wall thickness. This may be followed by forming an inwardly extending dome to the bottom of the can. That is, the can is moved into engagement with a domer; the domer having a domed end onto which the can is pressed. This action typically occurs at the end of the stroke of the punch. After the dome is formed, the can is removed from the punch for further processing.

This process is a repeating process and, as such, a reciprocating ram is used. For example, assuming that the cup is formed and disposed on the ram to be drawn into a can, the process typically includes the following steps. The ram moves forward during a forming stroke thereby passing the cup through at least one die pack. The die pack includes a die ring. The radius of the opening in the die ring is slightly larger than the radius of the punch. The radius of the opening in the die ring is, however, slightly smaller than the radius of the can disposed on the punch. Thus, as the punch moves through the die ring, the cup is deformed and, more specifically, the cup is elongated axially thereby thinning the sidewall so that the cup may pass through the die ring. The punch and cup may pass through one or more die rings within the die pack.

This process generates heat from friction that is undesirable. As such, the ram, punch, and die pack need to be cooled. Further, it is desirable to reduce the friction before heat is generated. It is known to spray a cooling liquid, e.g., water, oil, or an oil in water emulsion, onto the punch and die pack during operation. Thermal conductivity of the water cools the punch and die pack and use of the oil reduces friction. Such cooling liquids, however, have undesirable qualities. For example, oil in water emulsions may degrade over time as a result of microbial attack or hard water ion accumulation. Further, if the mixture contains toxic additives, the liquid may pose a waste treatment problem.

It is known that a supercritical fluid may be used in place of a cooling liquid in many metal working operations. The supercritical fluid, such as, but not limited to super critical $CO_2$ may be infused with a lubricant as well. Systems for creating, manipulating and applying supercritical fluids are expensive, however. Further, in the context of a bodymaker, a sprayed supercritical fluid would be applied to the punch and die pack as a liquid and, more specifically, micro-drops. The micro-drops of the supercritical fluid would evaporate almost instantly causing localized cooling rather than a substantially even cooling over the surface of the punch and die pack. Further, the lubricant, if used, builds up on the components and eventually breaks down physically/chemically leaving a residue that must be cleaned.

SUMMARY OF THE INVENTION

Accordingly, there is a need for a system for cooling a can bodymaker tool pack using a substantially dry cooling fluid. In the disclosed and claimed embodiment, a cooling gas system for a can bodymaker tool pack uses a compressed gas to cool the punch and die pack. That is, a compressed gas is delivered to at least one location adjacent the punch and die pack. A nozzle assembly directs the compressed gas toward a selected location. As the compressed gas passes through the nozzle, or immediately after passing through the nozzle assembly, the compressed gas expands. As is known, an expanding gas cools as it expands. Thus, a cool gas is directed to the surface of the punch and the die pack. The cool gas absorbs heat from the punch and die pack thereby cooling the heated components. The gas may then be exhausted from the system.

In one embodiment the gas is Nitrogen, $CO_2$, or other gases compressed to a pressure of between about 10 and 50 bars. As the gas expands through, or after, the nozzle assembly, the gas will be at a temperature of between about −75° C. and −200° C. In another embodiment, the nozzle assembly is structured to direct the gas in a circular, or swirling (e.g., helical), path that corresponds to the surface of the punch or the die ring. In this embodiment, the gas flow is, preferably, laminar. Alternatively, the nozzle assembly may include a turbulator structured to create a turbulent flow path. Further, the compressed gas may be infused with a liquid such as, but not limited to, water, a lubricant, and a lubricant in water emulsion. In one embodiment, the liquid is water that evaporates shortly after application.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, the word "unitary" means a component is created as a single piece or unit. That is, a component that includes pieces that are created separately and then coupled together as a unit is not a "unitary" component or body.

Figure 1:
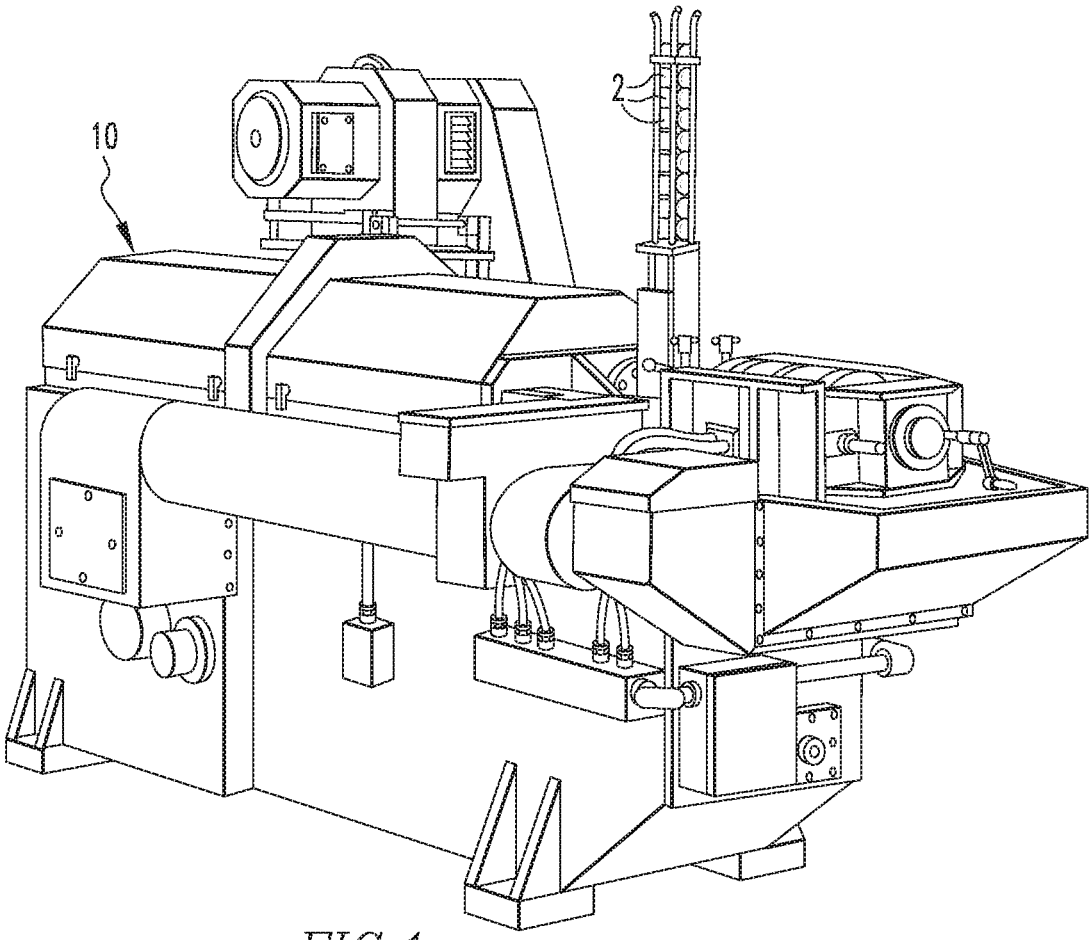
FIG. 1 is an isometric view of a can bodymaker.

As shown in FIG. 1, a can bodymaker 10 includes a tool pack 12 having a reciprocating ram 14 and a die pack 16. The ram 14 includes, preferably, an elongated, substantially cylindrical body 15 with a punch 17 mounted on the end of cylindrical body 15. The punch also includes a cylindrical body 19. The die pack 16 has at least one die ring 18 with an opening 20 sized to allow the punch 17 to pass therethrough. The ram 14 is structured to pass forward through the at least one die ring 18 during a forming stroke and backward through the at least one die ring 18 during a return stroke. This cycle is repeated.

Figure 2:
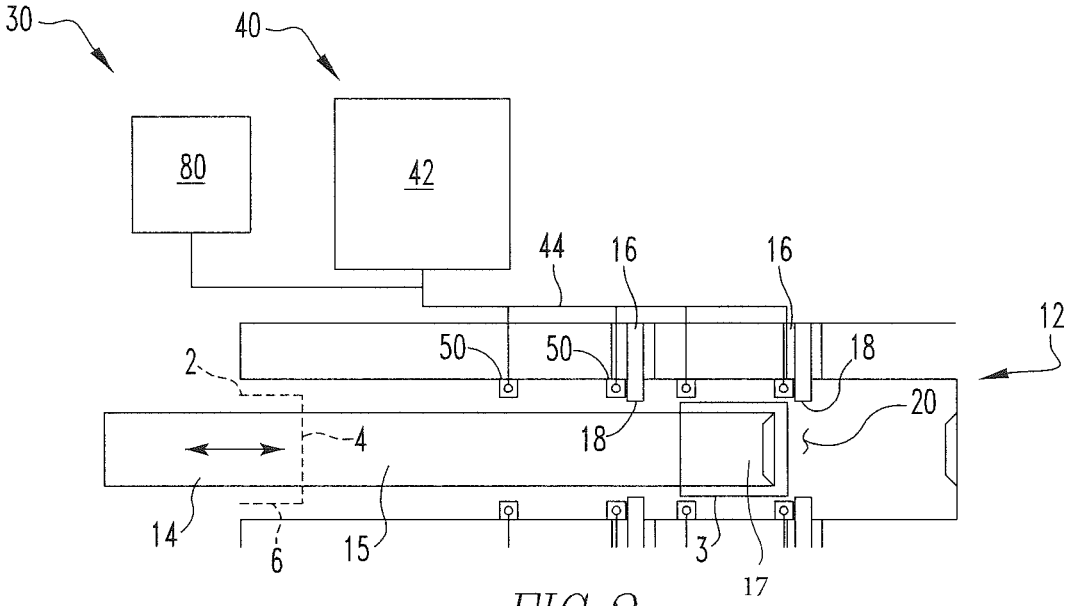
FIG. 2 is a schematic view of a tool pack.
Figure 3:
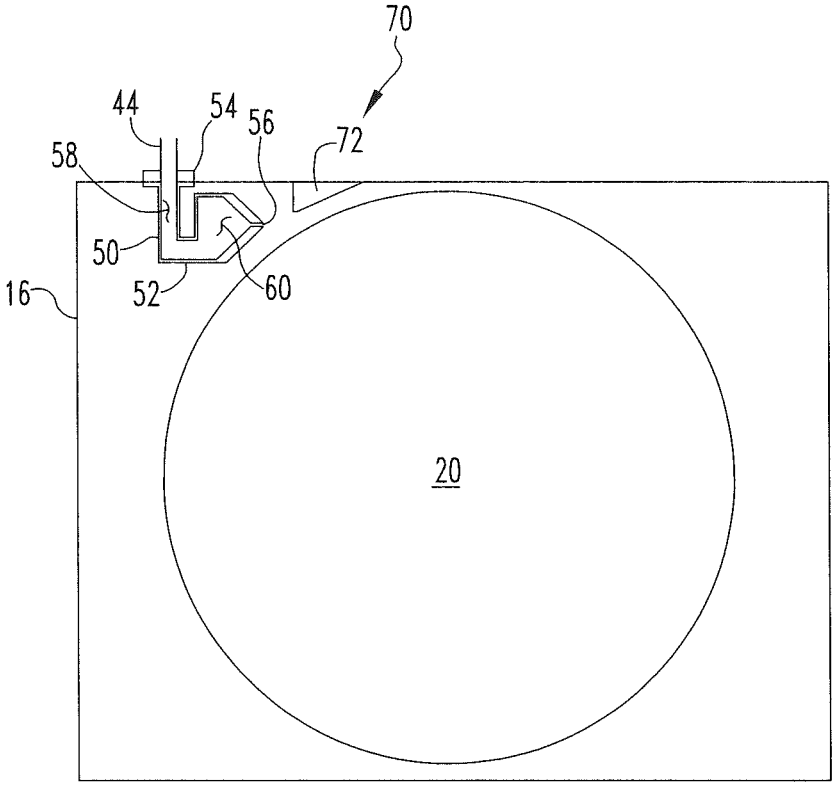
FIG. 3 is a schematic view of a nozzle assembly.

A cup 2, made from a malleable material and having a bottom 4 and a depending sidewall 6, is temporarily disposed in front of the punch 17 at the start of each cycle. The cup 2 can be redrawn in the bodymaker 10 prior to subsequent ironing, or, the cup 2 can be redrawn prior to insertion into the bodymaker 10. After the redraw operation, the cup 2 is sized to be slightly larger than the punch 17 and slightly smaller than the at least one die ring 18. At this point the cup is identified as a can 3 (FIG. 2). Thus, as the punch 17 carrying the can 3 passes through the at least one die ring 18, the can 3 is deformed and, more specifically, the can 3 becomes elongated while the sidewall 6 becomes thinner. If there is more than one die ring 18, the can 3 is always slightly larger than the next downstream die ring 18, i.e., the die ring 18 that the can 3 is moving toward. Thus, as the can 3 passes through each die ring 18, the can 3 becomes more elongated and the sidewall 6 becomes thinner. At the end of the forming stroke a dome may be formed in the can bottom 4 by known methods. Further, at the start of the return stroke, the can 3 is ejected from the punch 17 by any known method or device such as, but not limited to a stripper device or delivering a compressed gas to the inner side of the can 3. At the start of the next forming stroke a new cup 2 is disposed over the end of the punch 17.

The can bodymaker 10 further includes a cooling gas system 30 structured to cool the punch 17, die ring 18, and can 3. The cooling gas system 30 includes a compressed gas system 40 and at least one nozzle assembly 50. The compressed gas system 40 includes a compressed gas source 42 (shown schematically) and a compressed gas conduit 44. The compressed gas source 42 is, preferably, a compressed gas cylinder (not shown). In one alternative embodiment, the compressed gas source 42 includes a liquefied gas cylinder coupled to an evaporation circuit or similar device. In another alternative, and typically if the compressed gas is compressed air, the compressed gas source 42 may be a compressor. The compressed gas conduit 44 is coupled to, and in fluid communication with, both the compressed gas source 42 and each nozzle assembly 50. Each nozzle assembly 50 is disposed adjacent to either a punch 17 and/or a die ring 18. Thus, the compressed gas system 40 is structured to deliver a gas to at least one nozzle assembly 50, and, the at least one nozzle assembly 50 is structured to direct a gas toward at least one of the punch 17 and the at least one die ring 18.

In one embodiment, there are a plurality of nozzle assemblies 50 disposed both about and along the punch 17 and at each die ring 18. That is, a set of nozzle assemblies 50 may be disposed at a selected longitudinal position along the path of travel of the punch 17. Further, a set of nozzle assemblies 50 are, preferably, disposed adjacent to each die ring 18. Each set of nozzle assemblies 50, preferably, encircles the punch 17 or is disposed about the periphery of the adjacent die ring 18. Each nozzle assembly 50 is substantially similar and, as such, the following discussion addresses a single nozzle assembly 50. It is understood, however, that multiple nozzle assemblies 50 may be used as described above.

Each nozzle assembly 50 includes a body 52 having an inlet coupling 54, and outlet 56 and which defines a passage 58. The nozzle assembly inlet coupling 54 is coupled to, and in fluid communication with, the compressed gas conduit 44. The nozzle assembly passage 58 is, in one embodiment, an expansion chamber 60. That is, an expansion chamber 60 has a cross-sectional area that is greater than the compressed gas conduit 44. In this configuration, the compressed gas delivered via the compressed gas conduit 44 expands in the expansion chamber 60 causing a reduction in the temperature of the gas. The size of the expansion chamber 60 may be selected based upon the temperature and pressure of the compressed gas, and, the desired exit temperature of the gas. In an alternative embodiment, the nozzle assembly passage 58 is not an expansion chamber 60. In this embodiment, the compressed gas passes through the nozzle assembly 50 in a substantially compressed state and, upon exiting the nozzle assembly 50, rapidly expands and cools. The nozzle assembly outlet 56 is structured to provide a laminar, i.e., smooth, flow path for the gas. The nozzle assembly outlet 56 directs the gas toward at least one of the punch 17 and the at least one die ring 18. In the schematic figures, the nozzle assembly 50 is shown as being external to the die pack 16. The nozzle assembly 50, however, may be formed within the elements comprising the die pack 16. That is, the elements comprising the die pack 16 may include cavities that, when the elements comprising the die pack 16 are assembled, form the various passages of the nozzle assembly 50 and compressed gas system 40.

The nozzle assembly 50 may include a flow direction assembly 70. The flow direction assembly 70 may be incorporated into the nozzle assembly body 52, or, may be spaced therefrom but in a position to effect the gas flow path from the nozzle assembly 50. In one embodiment, the nozzle assembly 50 is structured to direct the gas in a path corresponding to the punch cylindrical body 19. That is, the gas flow path is generally circular or a spiral (helical) extending about the punch cylindrical body 19. Similarly, a nozzle assembly 50 near a die ring 18 may be structured to direct the gas in a path corresponding to the contour of the die ring 18, i.e., a circular or spiral path. Such flow paths may be created, or effected, by the flow direction assembly 70. That is, the flow direction assembly 70 may be structured to create a spiral gas flow path, the spiral gas flow path corresponding to one of the punch cylindrical body 19 or the contour of the die ring 18. The flow direction assembly 70 may be, but is not limited to, vanes 72 disposed within the can bodymaker 10. Further, the flow direction assembly 70 may be a turbulator 74 structured to create a turbulent flow. As used herein, a "turbulator" is a construct specifically designed to create a turbulent gas flow at a specific location. A structure that may have the effect of creating a turbulent flow, such as, but not limited to, a edge of the die pack 16, a fastener head in the die pack, etc. are not "turbulators."

The compressed gas is, in one embodiment, compressed Nitrogen, $CO_2$ or other gases, however any non-flammable gas may be used. The compressed gas is compressed at a pressure of between about 10 and 50 bars. As described below, the compressed gas is expanded at the nozzle assembly 50 to about atmospheric pressure. When Nitrogen, $CO_2$ or other gases at a pressure of between about 10 and 50 bars is reduced to about atmospheric pressure, the temperature of the gas is also reduced. Thus, the gas, which starts at about room temperature, exits the nozzle assembly 50 at a temperature of between about −75° and −200 degrees C. It is noted that Nitrogen, $CO_2$ or other gases in the identified temperatures and pressures are not in the supercritical state. Further, the disclosed and claimed compressed gas system 40 does not compress the gas to a supercritical state.

Thus, in this configuration, the cooling gas system 30 is structured to deliver and direct a chilled gas to the surface of the punch 17 and the at least one die ring 18, as well as the die pack 16. The chilled gas absorbs heat from the punch 17 and the at least one die ring 18. Moreover, in this embodiment, the cooling gas system 30 is dry; that is, the cooling system does not apply a liquid to the surface of the punch 17, the at least one die ring 18, or the cup 2. Such a configuration is especially desirable if the cup 2 is also structured to utilize a dry lubricant or no lubricant (and no wet lubricant is applied thereto). That is, if the cup 2 is dry and the cooling gas system 30 is dry, the can bodymaker 10 may be a "dry can bodymaker." As used herein, a "dry can bodymaker" is a can bodymaker 10 wherein the cup 2 is dry and the cooling gas system 30 is dry.

In an alternate embodiment, the compressed gas system 40 may include a liquid system 80 structured to incorporate a liquid in the compressed gas, the gas within the nozzle assembly 50, or the gas after exiting the nozzle assembly 50. The liquid system 80 is structured to apply a liquid to at least one of the punch 17, the at least one die ring 18, and the cup 2. The liquid in the liquid system 80 is at least one of water, a lubricant, and a lubricant in water emulsion. Thus, the liquid system 80 is structured to apply at least one of water, a lubricant, and a lubricant in water emulsion to at least one of the punch 17, the at least one die ring 18, and the cup 2. A "substantially dry can bodymaker" as used herein, is a can bodymaker 10 wherein the cup 2 is and the cooling gas system 30 utilize a limited amount of liquid. That is, a "limited amount of liquid" is 0.1 ml or less of liquid per cup 2 or can 3.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A cooling gas system for a can bodymaker tool pack, the can bodymaker tool pack having a reciprocating ram and a die pack, the ram having a punch mounted thereon, the die pack having at least one die ring with an opening sized to allow the punch to pass therethrough, the punch structured to axially pass through the die pack with a metallic cup on an end thereof during a forming stroke, wherein the cup is formed into a can while passing through the die ring, the can being stripped from the punch as the ram moves reversely through the die ring during a return stroke, the cooling gas system comprising:

at least one nozzle assembly disposed adjacent to the die ring, the at least one nozzle assembly including an outlet, the at least one nozzle assembly outlet structured to direct a gas toward at least one of the punch and the at least one die ring;

the at least one nozzle assembly outlet is structured to direct the gas in a path; and wherein the path is one of a circular path or spiral path.

2. The cooling gas system of claim 1 further including:

a compressed gas system structured to deliver a compressed gas to the at least one nozzle assembly;

the compressed gas system in fluid communication with the at least one nozzle assembly; and wherein the compressed gas expands to about atmospheric pressure as it passes through the at least one nozzle assembly.

3. The cooling gas system of claim 1 wherein the gas that the at least one nozzle assembly is structured to direct to at least one of the punch and the at least one die ring is a chilled gas.

4. The cooling gas system of claim 1 wherein:

the least one nozzle assembly includes a body;

wherein the least one nozzle assembly body includes an inlet coupling and an outlet;

wherein the at least one nozzle assembly body further defines a passage; and wherein the at least one nozzle assembly body passage is an expansion chamber.

5. A can bodymaker comprising:

at least one die ring with an opening sized to allow a punch to pass therethrough;

a reciprocating ram;

a punch, the punch mounted on the ram;

the ram positioned so that the punch reciprocates through the at least one die ring opening;

a cooling gas system including a compressed gas system and at least one nozzle assembly;

the compressed gas system structured to deliver a gas to the at least one nozzle assembly; and the at least one nozzle assembly disposed adjacent to the die ring, the at least one nozzle assembly structured to direct a gas toward at least one of the punch and the at least one die ring.

6. The can bodymaker of claim 5 wherein:

the gas delivered by the compressed gas system is a compressed gas; and and wherein the compressed gas expands to about atmospheric pressure as it passes through the at least one nozzle assembly.

7. The can bodymaker of claim 6 wherein the compressed gas system delivers the compressed gas to the nozzle assembly at a pressure of between about 10 and 50 bars.

8. The can bodymaker of claim 6 wherein the at least one nozzle assembly directs the gas toward the at least one of the punch and the at least one die ring at a temperature of between about −75 and −200 degrees C.

9. The can bodymaker of claim 6 wherein the at least one nozzle assembly is structured to direct the gas in a laminar flow.

10. The can bodymaker of claim 6 wherein:

said at least one nozzle assembly includes a body;

the at least one nozzle assembly includes a flow direction assembly; and wherein said flow direction assembly is spaced from said at least one nozzle assembly body.

11. The can bodymaker of claim 10 wherein the flow direction assembly is structured to create a spiral gas flow path, the spiral gas flow path corresponding to one of the punch cylindrical body or the contour of the die ring.

12. The can bodymaker of claim 10 wherein the flow direction assembly is a turbulator.

13. A dry can bodymaker comprising:

at least one die ring with an opening sized to allow a punch to pass therethrough;

a reciprocating ram;

a punch, the punch mounted on the ram;

the ram positioned so that the punch reciprocates through the at least one die ring opening;

a cooling gas system including a compressed gas system and at least one nozzle assembly;

the compressed gas system structured to deliver a gas to the at least one nozzle assembly; and the at least one nozzle assembly disposed adjacent to the die ring, the at least one nozzle assembly structured to direct a gas toward at least one of the punch and the at least one die ring.

14. The dry can bodymaker of claim 13 wherein:

the gas delivered by the compressed gas system is a compressed gas; and wherein the compressed gas expands to about atmospheric pressure as it passes through the at least one nozzle assembly.

15. The dry can bodymaker of claim 14 wherein the punch has a generally cylindrical body and wherein the at least one nozzle assembly is structured to direct the gas in a path corresponding to the punch cylindrical body.

16. The dry can bodymaker of claim 14 wherein the at least one nozzle assembly is structured to direct the gas in a path corresponding to the contour of the die ring.

17. The dry can bodymaker of claim 13 wherein the compressed gas system does not compress the gas to a supercritical state.

18. The dry can bodymaker of claim 13 wherein:

said at least one nozzle assembly includes a body;

the at least one nozzle assembly includes a flow direction assembly; and wherein said flow direction assembly is spaced from said at least one nozzle assembly body.

19. The dry can bodymaker of claim 18 wherein the flow direction assembly is structured to create a spiral gas flow path, the spiral gas flow path corresponding to one of the punch cylindrical body or the contour of the die ring.

* * * * *